US006871884B2

(12) United States Patent
Hoffmann et al.

(10) Patent No.: US 6,871,884 B2
(45) Date of Patent: Mar. 29, 2005

(54) BAR LOCK FOR A LOCKING SYSTEM

(75) Inventors: Rainer Hoffmann, Langenfeld (DE); Manfred Sauerland, Essen (DE)

(73) Assignee: EMKA Beschlagteile GmbH & Co. KG (DE)

( * ) Notice: Subject to any disclaimer, the term of this patent is extended or adjusted under 35 U.S.C. 154(b) by 35 days.

(21) Appl. No.: 10/297,154

(22) PCT Filed: May 30, 2001

(86) PCT No.: PCT/DE01/02057

§ 371 (c)(1),
(2), (4) Date: Mar. 6, 2003

(87) PCT Pub. No.: WO01/92667

PCT Pub. Date: Dec. 6, 2001

(65) Prior Publication Data

US 2003/0159477 A1 Aug. 28, 2003

(30) Foreign Application Priority Data

Jun. 2, 2000 (DE) ..... 200 09 771 U

(51) Int. Cl.[7] ..... E05C 9/12

(52) U.S. Cl. ..... 292/39; 292/22; 292/36; 292/112; 292/142; 292/160; 292/DIG. 51; 70/190

(58) Field of Search ..... 292/39, 35, 36, 292/41, 142, 22, 112, 160, 279, DIG. 51, DIG. 53, 336.3; 70/190

(56) References Cited

U.S. PATENT DOCUMENTS

| | | | | | |
|---|---|---|---|---|---|
| 228,241 | A | * | 6/1880 | Zimmerman | 292/39 |
| 356,143 | A | * | 1/1887 | Livingstone | 292/22 |
| 1,536,773 | A | * | 5/1925 | Ciaccio | 70/240 |
| 2,166,535 | A | * | 7/1939 | Sarenholm et al. | 292/5 |
| 2,584,088 | A | * | 1/1952 | Floyd | 292/34 |
| 4,002,360 | A | * | 1/1977 | Frank et al. | 292/336.3 |
| 4,063,763 | A | * | 12/1977 | van Herpen | 292/39 |
| 4,616,864 | A | * | 10/1986 | Douglas | 292/336.3 |
| 4,658,664 | A | * | 4/1987 | Jacobs et al. | 74/422 |
| 4,848,811 | A | * | 7/1989 | Laufenburg et al. | 292/142 |
| 4,932,696 | A | * | 6/1990 | White | 292/336.3 |
| 4,998,757 | A | * | 3/1991 | Ramsauer | 292/39 |
| 5,039,143 | A | * | 8/1991 | Ramsauer | 292/39 |
| 5,118,143 | A | * | 6/1992 | Gerard | 292/39 |
| 5,253,903 | A | * | 10/1993 | Daley | 292/39 |
| 5,347,834 | A | * | 9/1994 | Ramsauer | 70/120 |
| 5,509,703 | A | * | 4/1996 | Lau et al. | 292/1 |
| 5,887,915 | A | * | 3/1999 | Ramsauer | 292/160 |
| 6,035,674 | A | * | 3/2000 | Nickel | 70/103 |
| 6,374,651 | B1 | * | 4/2002 | Thielmann et al. | 70/210 |

FOREIGN PATENT DOCUMENTS

| | | | |
|---|---|---|---|
| DE | 1962780 | * | 12/1969 |
| DE | DE1950153 | * | 6/1970 |
| DE | DE4409420 | * | 9/1994 |
| EP | 0 261 267 | | 3/1988 |
| EP | EP490287 | * | 6/1991 |
| EP | 0 620 343 | | 10/1994 |
| EP | 0 665 353 | | 8/1995 |
| FR | 1013125 | * | 7/1952 |
| FR | 2592085 | * | 10/1985 |

* cited by examiner

*Primary Examiner*—William L. Miller
*Assistant Examiner*—Carlos Lugo
(74) *Attorney, Agent, or Firm*—R W Becker & Associates; Robert W Becker

(57) ABSTRACT

A bar lock for a locking system is provided, and comprises a lock body having guide slots and two recessed areas symmetrically disposed on opposite sides between the guide slots and separated from one another by a central member. Two lock bars are received in the guide slots and have engagement openings. Two spaced apart pinions are received in the recessed areas. Rotation of the pinions is converted into a longitudinal displacement of the lock bars. The pinions are positively interconnected via a plug.

10 Claims, 3 Drawing Sheets

BAR LOCK FOR A LOCKING SYSTEM

BACKGROUND OF THE INVENTION

The invention relates to a bar lock for a locking system that is to be used in particular in metal cabinet doors, comprising a lock body having guide slots disposed therein for receiving at least one lock bar that is guided in the lock body, and at least one pinion that is disposed in the lock body and that via its external teeth is in engagement with holes formed in the lock bar along the longitudinal axis thereof in such a way that a rotation of the pinion is converted into a longitudinal displacement of the lock bar, and which pinion has a centrally disposed engagement opening for the positive engagement of an actuating device such as a handle, pivot lever, socket wrench, or the like.

A bar lock having the aforementioned features is known from EP 0 261 267 B2; the known bar lock is preferably used in the switch cabinet industry as a component of a locking system for thin-walled metal cabinet doors that have at least one, in particular rectangular door recess for the mounting of the locking system. In this connection, placed upon the outer side of the door is a base plate having a receiving means for the actuating means such as a handle, pivot lever, socket wrench, or the like, and is screw-connected or otherwise fastened with the lock body that is placed upon the inner side of the door, so that the door panel is fixedly clamped between the base plate and the lock body. With the known bar lock, the lock body is composed of two symmetrically formed lock body halves, whereby the two lock body halves together form the guide slot for the at least one lock bar; preferably two lock bars are simultaneously used. Centrally mounted in the lock body, and encased by and between the lock body halves, is a pinion that via a respective bearing member rotates in an associated mounting bore of each lock body half, and which via its external teeth engage in a single perforation that extends along the longitudinal axis of the pertaining lock bar. The lock body halves are joined together via a plug connection, and the lock body is secured to the base plate via screws that extend through both of the lock body halves and engage the base plate that is disposed on the outer side of the door.

The known bar lock has the drawback that the assembly and mounting of the bar lock is complicated because the pinion is to be placed together with the in particular two lock bars into one of the lock body halves, whereby the lock bars are introduced into the guide slots and at the same time the pinion, with its bearing member, is to be placed into the mounting recess that is provided; subsequently, the two lock body halves must be mounted and then either the two placed-together lock halves must be secured to the base plate via through-bolts, or the lock body halves must be wedged together.

The object of the invention is to embody a bar lock having the aforementioned features in such a way that its assembly is simplified.

SUMMARY OF THE INVENTION

The realization of this object, including advantageous embodiments and further developments of the invention, results from the content of the patent claims that follow this description.

The basic concept of the invention is that the lock body is embodied as a single or monolithic component having the guide slots recessed therein on its oppositely disposed longitudinal sides, and on both sides a respective recessed area is symmetrically arranged between the guide slots for receiving a respective pinion placed into the recessed area, whereby the recessed areas are separated from one another by a central member formed in the lock body, and the guide slots, in the region of the recessed areas, are each provided with a window for the engagement of the teeth of the pinion disposed in the recessed area into the plane of the lock bar disposed in the guide slots, and whereby the pinions, via a connecting body that extends through an opening of the central member, are positively interconnected, and in that the lock bar has two parallel rows of engagement openings for the teeth of the pinion that have the spacing of the pinion that is disposed in the lock body, and first engagement openings disposed at the end of the lock bar that is to be inserted into the lock body are embodied as a laterally open toothing and subsequent engagement openings are embodied as perforations.

The invention has the advantage that the monolithic lock body is easier to handle during the assembly of the bar lock as well as during the mounting of the bar lock on the base plate. For the assembly, the lock bars are inserted into the guide slots of the lock body to such an extent that their open toothing is disposed in the windows of the lock body between the guide slots and the recesses; in this position, the pinions can be placed into the pertaining recesses or recessed areas, whereby the teeth of the respective pinion come to rest in the open toothing of the associated lock bar. The two thus inserted pinions are then interconnected via the connecting body, preferably in the form of a plug, that is to be disposed in the square inner hole of the pinion. If subsequently the lock bars are inserted further into the lock body, the teeth of the pinions engage into the respectively associated perforations of the pertaining lock bar and are also thereby held in the lock body.

Pursuant to one embodiment of the invention, it is provided that the pinions be interconnected via a plug that extends through the opening of the central member and is provided with a square inner hole, whereby it can be provided that on the other side of the plug there be formed a shoulder that conforms to the width of each pinion for the defined fixing of the pinion in place upon the outer periphery of the plug. In particular, the pinions can be placed via a square inner hole upon the plug, which is provided on its outer side with a square shape, whereby the pinion can also be wedged with the plug. To improve the transfer of force between the plug and the pinions, it can be provided that the outer square shape of the plug be provided on two oppositely disposed corners with an extension shoulder that externally spans the respective corner in a right-angled manner, and the square inner hole of the pinion is adapted to the shape of the outer square of the plug, including the extension shoulders. With a view toward an advantageous reduction of the number of individual parts, it can be provided that the plug be monolithically formed with one of the two pinions, and that the other pinion be placeable upon the plug.

In an alternative embodiment of the invention, it can be provided that the pinion, in a symmetrical embodiment, be monolithically formed with a respective peripheral portion of the plug, and the peripheral portions of the plug that are respectively disposed on the two pinions together form the plug when the two pinions are joined together, whereby the peripheral portions respectively extend over a quarter of a circle and can be disposed in the region of the oppositely disposed corners of the square inner hole. With this embodiment, it is expedient if the pinions can be joined together with peripheral portions of the plug via a plug-type connection formed on the peripheral portions.

It can finally be provided that the other recessed area of the lock body, which is not engaged by the actuating device, be adapted to be closed off by means of an insertible protective cover.

BRIEF DESCRIPTION OF THE DRAWINGS

Exemplary embodiments of the invention are shown in the drawings, which will be subsequently described. Shown are.

DESCRIPTION OF PREFERRED EMBODIMENTS

Figure 1:
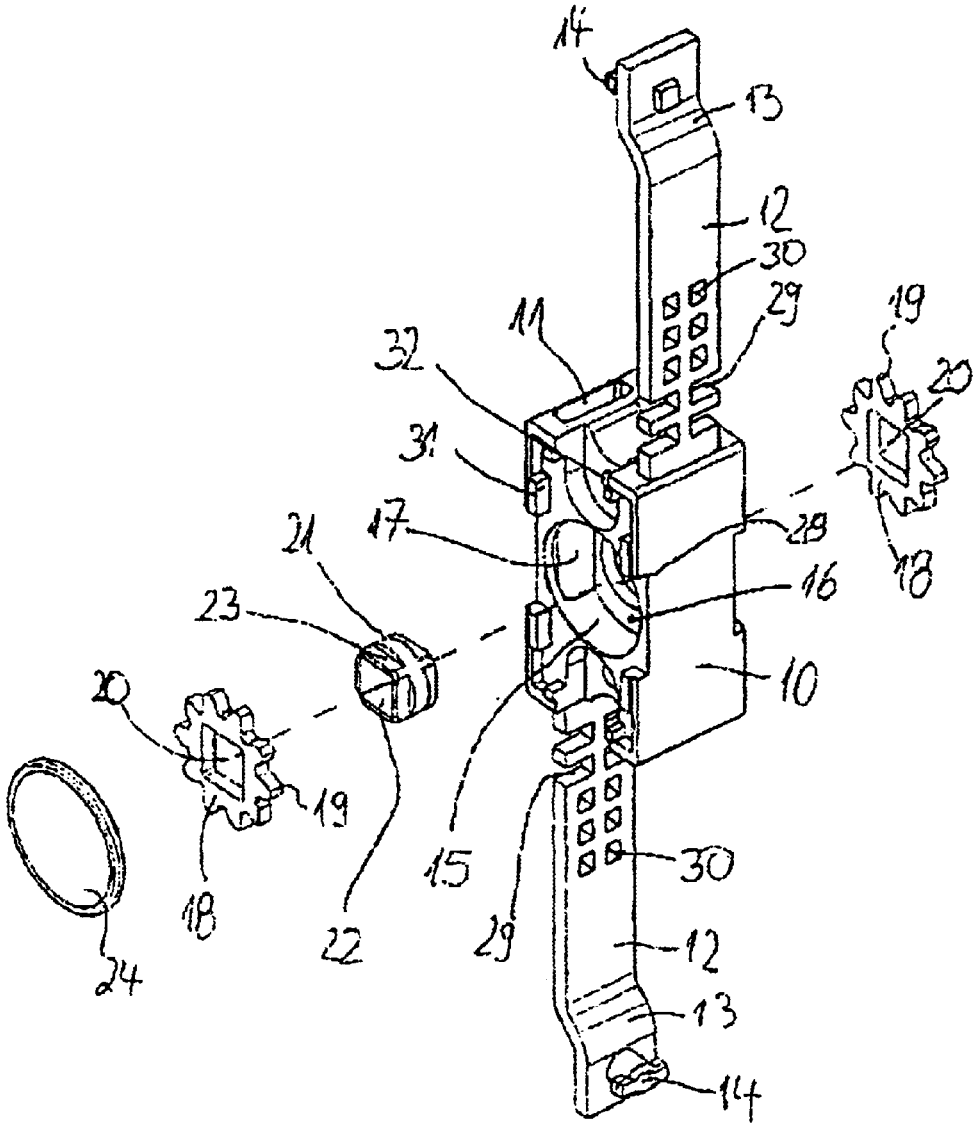
FIG. 1 An exploded illustration showing details of a bar lock.
Figure 2:
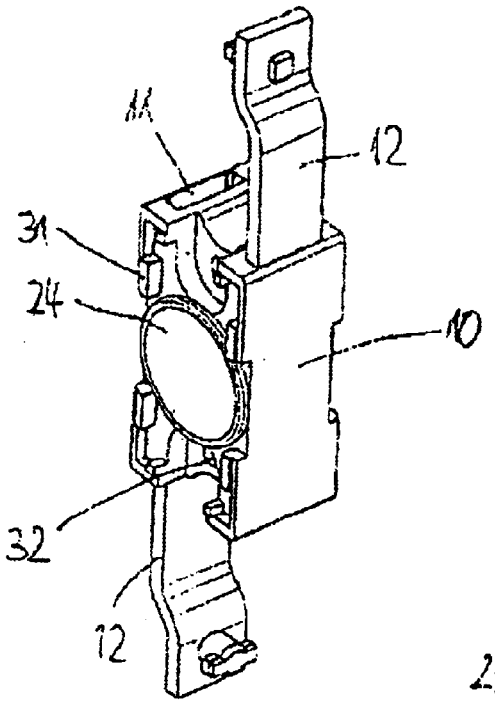
FIG. 2 The bar lock of FIG. 1 in the assembled state.

As can be initially seen in FIG. 1, the bar lock is provided with a one-piece or monolithic lock body 10 having a rectangular cross-section, on the parallel, oppositely disposed longitudinal sides of which guide slots 11 are formed in the lock body 10 into which respective lock bars 12 can be inserted.

With a view toward the use of the bar lock in a locking system, each of the lock bars 12 has an elbow or shoulder 13 as well as attachment means 14 for the mounting of further locking bars; such a locking system is described in detail in the generic EP 0 261 267 B2.

In a symmetrical arrangement, the lock body 10 is provided on both sides, between the guide slots 11, with a respective recessed area 15 for receiving a pinion 18; the two recessed areas 15 are interconnected by a central member 16 that is formed in the lock body 10 and that in turn has an opening 28.

Each recessed area 15 intersects the two guide slots 11, and in this region a respective window 17 is formed so that the outwardly disposed teeth 19 of the pinion 18 extend into the plane of the guide slots 11 and can here be brought into engagement with the lock bars 12 that are introduced into the guide slots 11. The two pinions have a square inner hole 20, so that the two pinions 18 are interconnected via a plug 21 that is inserted into the square inner holes 20 thereof and that in turn is provided with a square inner hole 22 for the engagement of the actuating device. The actuation, which is not illustrated in the present application, yet is described in detail in the generic EP 0 261 267 B2, can be brought via an associated square-end shaft into engagement with the plug 21, so that by rotating the plug 21 the pinions 18 are rotated. The outer periphery of the plug 21 is provided with respective shoulders 23, so that the pinions 18 are to be connected with the plug 21 in a defined position.

Each of the lock bars 12 has two rows of engagement openings for the teeth 19 of the two pinions 18, whereby the two rows of engagement openings, which are disposed parallel to one another in the longitudinal axes of the lock bars 12, are coordinated to the position of the pinions 18 that are disposed in the recessed areas 15. In this connection, the first two engagement openings, which are disposed on those ends of the lock bars 12 that are to be respectively inserted into the lock body 10, are embodied as a laterally open toothing 29 while the further engagement openings are embodied as perforations 30.

Finally, that recessed area 15 that is not engaged by the actuating means is to be closed off via a protective cover 24. The lock body 10 is furthermore provided on its end face with projecting ribs 31 that are intended for engagement in a door recess, as well as with screw holes 32 into which appropriate fastening screws can be inserted for mounting of the bar lock on a base plate.

Figure 3:
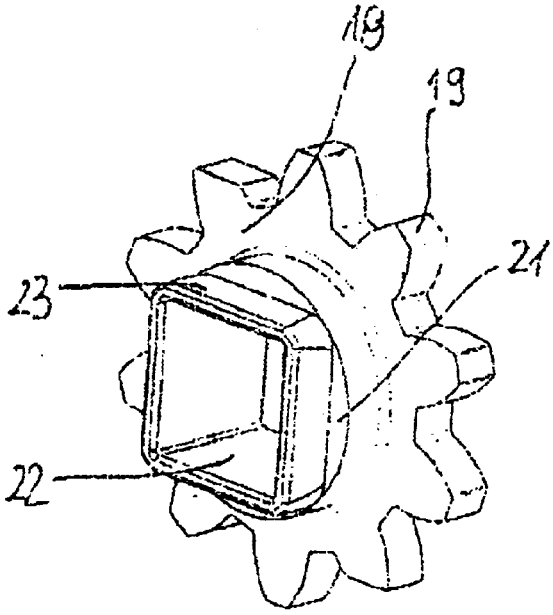
FIG. 3 A detailed view of an embodiment of a pinion for use in the bar lock of FIGS. 1, 2, FIG. 4*a* A detailed view of an embodiment of a plug that is to be placed into the bar lock of FIGS. 1, 2, FIG. 4*b* A front view of the subject matter of FIG. 4*a,*

As can be seen from FIG. 3, the plug 21 could be monolithically formed with one of the two pinions 18, so that the other pinion 18 can be placed upon the projecting shoulder 23 of the plug 21.

Figure 4A:
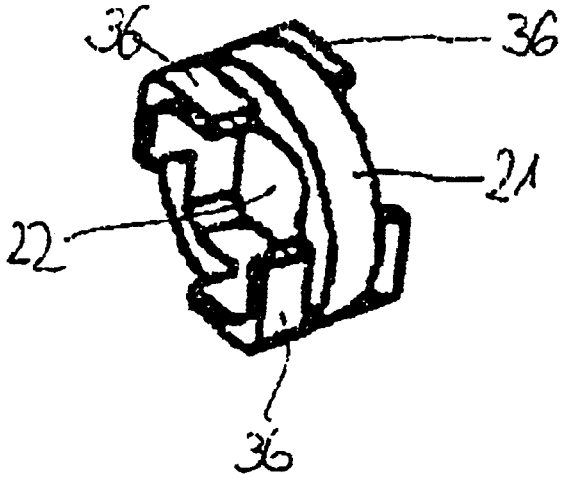
FIG. 4*c* A plan view of the pinion pertaining to the plug of FIGS. 4*a, b,*
Figure 4B:
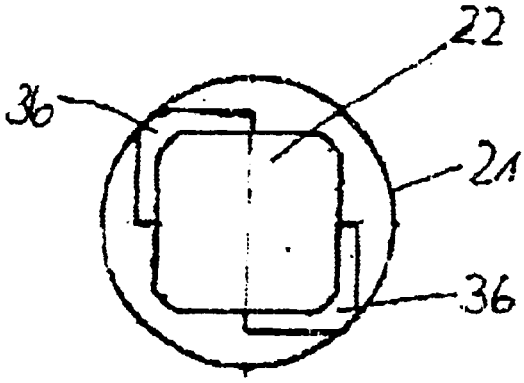
Figure 4C:
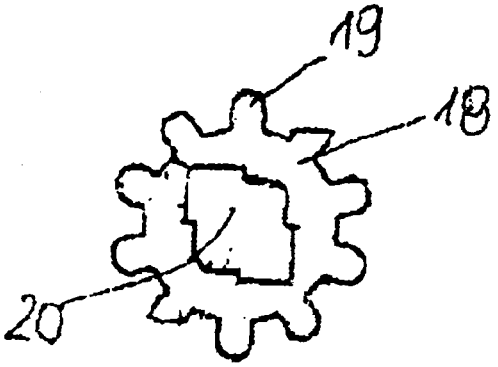

The further embodiment of FIGS. 4*a–c* illustrates the plug 21, with the pertaining pinion 18, and which plug is to be inserted into the bar lock, whereby the external square of the plug 21, or two oppositely disposed corners of the shoulder 23 thereof, are provided with an extension shoulder 36 that externally spans the respective corner in a right-angled manner. In conformity therewith, as can be seen from FIG. 4*c*, the square inner hole 20 of the pinion 18 is adapted to the shape of the external square of the plug 21 or of the shoulder 23 thereof, including the extension shoulders 36 disposed thereon, so that in this way the transmission of torque between the plug 21 and the pinions 18 is improved, and a twisting-off of the plug 21 at high load is prevented.

Figure 5:
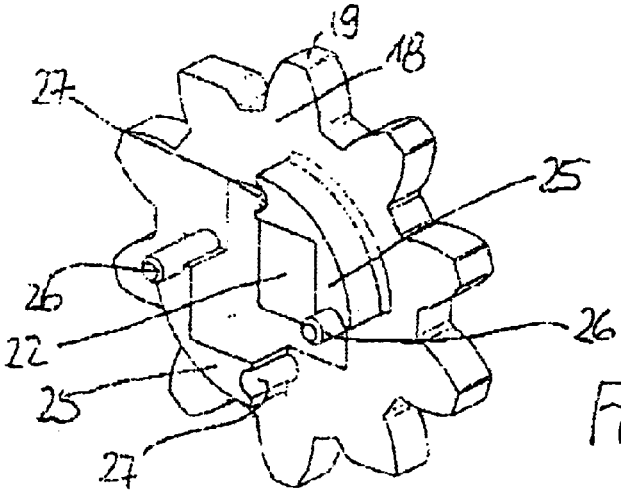
FIG. 5 Another embodiment of the pinion of FIG. 3.

FIG. 5 illustrates another exemplary embodiment of a pinion 18 with plug 21, whereby on a pinion 18 two peripheral portions 25 are monolithically formed with the pinion 18, the peripheral portions respectively extending over a quarter of a circle and being disposed in the region of oppositely disposed corners of the square inner hole 22 of the plug 21. The pinions 18, with the peripheral portions 25 disposed thereon, are identically embodied so that the pinions 18 can be mounted together in a position rotated by 90 degrees relative to one another such that the plug 21 results as a consequence of inter-engagement of the peripheral portions 25. Associated herewith in particular is the advantage of an improved transfer of force between the two individual pinions 18. It is furthermore provided that the two pinions 18 are to be assembled together via a plug-type connection, whereby the plug-type connection is formed from respectively two guide or insertion pins 26 and two associated receiving openings 27 that engage one another when the two pinions 18 are joined together.

The features of the subject matter of this document disclosed in the preceding description, the patent claims, the abstract and the drawing can be important not only individually but also in any desired combination with one another for realizing the various embodiments of the invention.

The specification incorporates by reference the disclosure of German priority document 200 09 771.7 filed Jun. 2, 2000 and International priority document PCT/DE01/02057 filed 30 May 2001.

The present invention is, of course, in no way restricted to the specific disclosure of the specification and drawings, but also encompasses any modifications within the scope of the appended claims.

What is claimed is:

1. A bar lock for a locking system, comprising:

a lock body having guide slots, wherein said lock body is a monolithic component having said guide slots recessed therein on opposite longitudinal sides of said lock body, wherein said lock body has two recessed areas that are symmetrically disposed on opposite sides between said guide slots and are separated from one another by a central member of said lock body, wherein in a vicinity of said recessed areas each guide slot is provided with a window;

two lock bars guided in said lock body and received in said guide slots thereof, wherein each of said lock bars is provided with engagement openings that extend in a direction of a longitudinal axis of said lock bars, wherein each lock bar has two parallel rows of said engagement openings, wherein first ones of said engagement openings are disposed on an end of said lock bars that are to be inserted into said lock body and are embodied as a laterally open toothing, and wherein second ones of said engagement openings that follow said laterally open toothing are embodied as perforations;

two spaced apart pinions received in respective ones of said recessed areas of said lock body, wherein said parallel rows of said engagement openings of each of said lock bars are spaced apart by a distance that corresponds to a spacing of said spaced apart pinions, wherein said pinions are provided with external teeth that extend through said windows to engage said engagement openings, of said lock bars such that a rotation of said pinions is converted into a longitudinal displacement of said lock bars, wherein said pinions are furthermore provided with a centrally disposed engagement opening; and a connecting body or plug that extends through an opening in said central member, wherein said pinions are positively interconnected via said plug.

2. A bar lock according to claim 1, wherein said plug is provided with a square inner hole.

3. A bar lock according to claim 2, wherein an outer side of said plug is provided with a shoulder that is adapted to a width of each of said pinions, and wherein said shoulder serves for a defined fixing of said pinions in position upon an outer periphery of said plug.

4. A bar lock according to claim 2, wherein an outer side of said plug has a square shape, and wherein said engagement opening of said pinions is a square inner hole that is placeable upon said square shape of said plug.

5. A bar lock according to claim 4, wherein two oppositely disposed corners of said outer square of said plug are provided with respective extension shoulders that span the respective corners toward the outside in a right-angled manner, and wherein said square inner holes of said pinions are adapted to a shape of said outer square of said plug and its extension shoulders 36.

6. A bar lock according to claim 2, wherein said plug is monolithically formed with one of said two pinions, and the other of said pinions is placeable upon said plug.

7. A bar lock according to claim 2, wherein in a symmetrical configuration said pinions are monolithically embodied with respective peripheral portions of said plug, and wherein said peripheral portions of said plug that are respectively disposed on said two pinions together form said plug if said pinions are joined together.

8. A bar lock according to claim 7, wherein said peripheral portions each extend over a quarter of a circle and are disposed in a region of oppositely located corners of said square inner hole of said plug and pinions.

9. A bar lock according to claim 7, wherein said pinions, with said peripheral portions of said plug, are adapted to be joined together via a plug-type connection formed on said peripheral portions.

10. A bar lock according to claim 1, wherein only one of said recessed areas is engaged by said actuating device, and the other recessed area of said lock body is adapted to be closed off via an insertible protective cover.

* * * * *